United States Patent [19]

Phibbs

[11] Patent Number: 4,643,694

[45] Date of Patent: Feb. 17, 1987

[54] HAND CONTROLLED PUPPET

[76] Inventor: Hugh C. Phibbs, 872 Kentucky St., Arlington, Va. 22205

[21] Appl. No.: 773,880

[22] Filed: Sep. 9, 1985

[51] Int. Cl.[4] ..... A63H 3/14

[52] U.S. Cl. ..... 446/327; 446/329

[58] Field of Search ..... 446/327, 328, 329, 359, 446/361, 362, 363

[56] References Cited

U.S. PATENT DOCUMENTS 2,860,446 11/1958 Williams ..... 446/363

3,801,495 8/1957 Enison ..... 446/329

FOREIGN PATENT DOCUMENTS 657992 10/1951 United Kingdom ..... 446/362

*Primary Examiner*—Mickey Yu

[57] ABSTRACT

A hand held puppet comprised of a hinged body having jointed arms and legs, and a head with actuators for each which are positioned to be engaged by each of the user's fingers for controlling movement thereof with the arms being formed by "V" shaped members pivoted at their respective bases. Actuating wires are also provided for moving the forearms and the jaw of the puppet.

4 Claims, 1 Drawing Figure

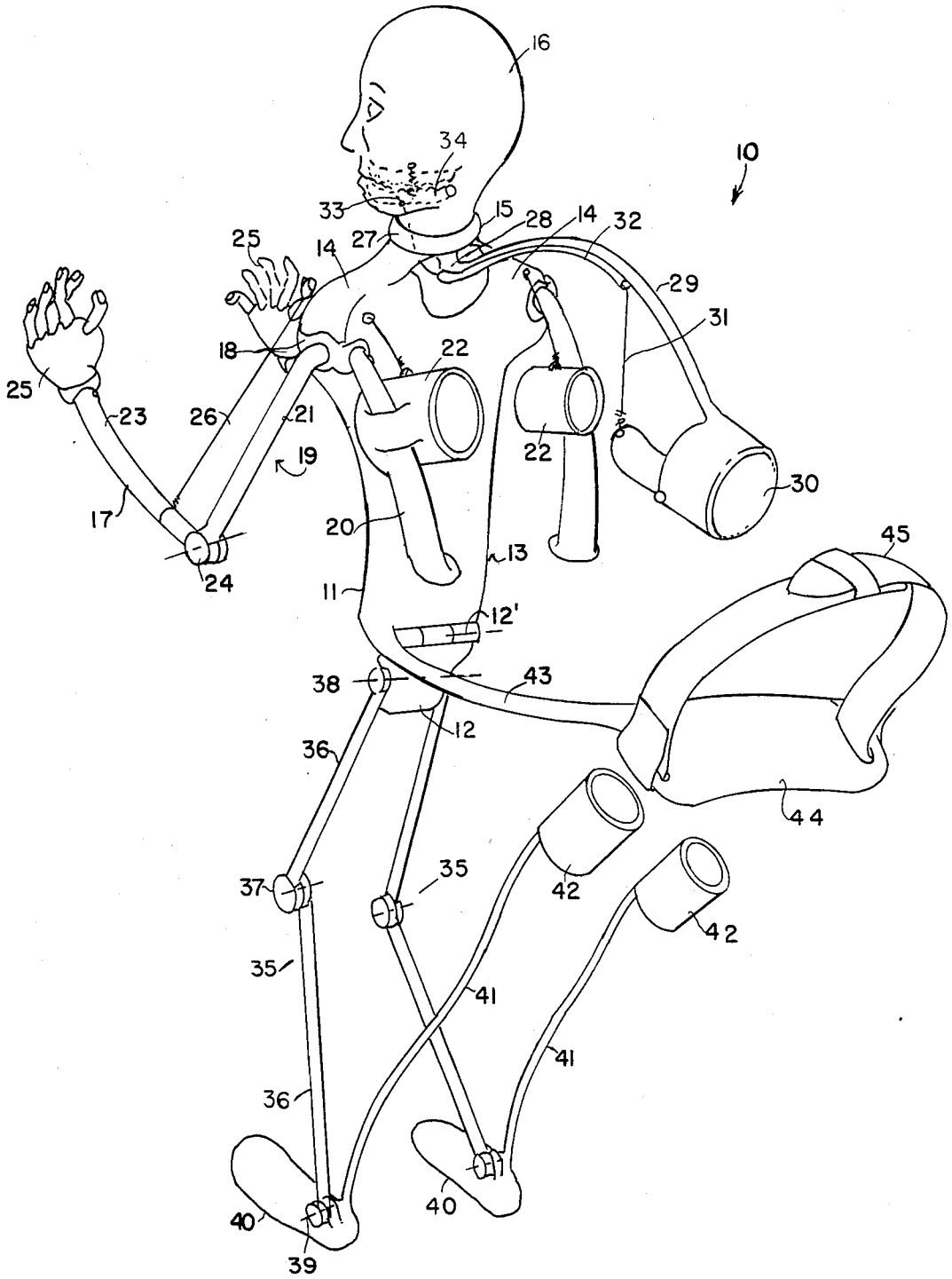
16
34
10
33
15
28
14
32
25
27
14
29
31
18
22
25
23
26
21
19
22
30
17
20
13
45
24
11
12'
38
43
12
36
44
37
35
42
42
35
41
41
36
40
40
39

HAND CONTROLLED PUPPET

BACKGROUND OF THE INVENTION

The use of puppets for enjoyment and entertainment is well known and the design and controls of the same have been the subject of several patents directed thereto, typified by the following:

| | |
|---|---|
| 1,648,411 | 2,633,670 |
| 2,114,851 | 2,771,708 |
| 2,155,665 | 4,186,517 |
| 2,551,195 | 4,457,097 |

SUMMARY OF THE INVENTION

The object of this invention is to provide a single hand finger controlled puppet which is designed to provide actuators for each of the arms, legs and head. Generally, the puppet is comprised of a torso having hinge means separating the legs from the trunk thereof, with pivoted legs disposed on the lower half, and pivoted arms on the torso half. Each arm and leg has an actuator rod extending therefrom terminating in a push button or finger gripping member. The head, in turn, is also provided with an actuator similar to that of the legs and arms. A main hand support extends rearwardly from the torso and terminates in a strap means in which the user's hand is slipped to provide the main support in the use of the puppet.

BRIEF DESCRIPTION OF THE DRAWINGS

The sole figure is a perspective view showing the puppet and the disposition of the actuators with respect to the movable components thereof.

DESCRIPTION OF THE PREFERRED EMBODIMENT

With reference to the sole figure, a puppet of the present invention is depicted generally at 10 and is seen to include a torso 11 having a lower leg supporting body 12 and an upper arm supporting body 13. As seen therein, the body 13 diverges upwardly and outwardly from the leg portion terminating in rounded shoulders 14, 14 which move inwardly to a neck region 15 whereat the head 16 is disposed. Adjacent each of the shoulders the arms 17,17 are positioned and are comprised of a rotating support plate 18 secured to the body and providing support for a unitary V-shaped member 19 having depending links 20,21 fixed thereto. It is considered to be within the purview of the disclosure to use other joint structure other than that as shown at 18,19 as, for example, a ball and socket. As seen, link 20 supports a sliding finger-engaging member 22, medially thereof, while link 21 supports another link 23 adjacent the other end thereof. The link 23 is pivoted at 24 to the link 21 and has it's free end terminating in a hand 25 which is hinged to 23 and the fingers of which are hinged thereto. The link 23 is secured to the actuator 22 by a thread or wire 26 which passes through a hole in the shoulder 14. As is obvious, pressure on the actuator 22 will cause upward movement of the wire or string 26 thereby lifting the hand supported link 23, as well as imparting overall motion to the arm 17 and will cause the hand 25 and it's hinged fingers to fall into different configurations on their hinges.

With continuing reference to the drawing, the head 16 is seen to be movably disposed within a collar 27 secured adjacent the neck area 15 and is anchored therein by a depending tab 28 which terminates in an arcuately shaped actuator 29. The free end of the actuator 29 supports a finger-engaging member 30 which is similar to the actuators 22,22 of the arms, and like those controls, includes an actuating wire or thread 31, secured thereto, which is positioned and threaded through an auxiliary housing 32, with the free end thereof 33, being connected to a lower movable jaw 34, on the head 16.

As seen, the lower half of the body 12 is hingedly pivoted at 12' to main torso 13 and supports a pair of legs 35, 35 each comprised of a pair of links 36,36 pivoted to one another in the knee area 37, with the free end of one of the links 36, being pivoted at 38 to the body 12 and the free end of the other link 36, being pivoted at 39 to the foot 40. Each of the legs have an elongated support member 41, 41, extending upwardly from the feet 40 and terminating in finger-engaging members 42,42.

The main support for the puppet 10 constitutes a support arm 43 extending rearwardly from the areas adjoining the lower and upper body portions back to a support member 44 having an adjustable securing strap 45 positioned thereon. The surface 44 provides a support for the palm of the user's hand. The strap 45 can be adjusted to compensate for varying hand shapes.

In use, the user slips his hand with the plam thereof resting on the support 44 and places his index finger and middle fingers in engagement with the actuators 22 and 22 while the base of his thumb engages actuator 30 for controlling head and jaw movements 16, 34 respectively. The two remaining fingers then engage actuators 42, 42 for controlling leg motion.

It is therefore apparent that depending on the dexterity of the user's hand, he can quite cleverly control arm, leg and head motion by the use of one hand.

It is apparent that the puppet can be made from any economical material such as plastic, plywood, wire, and that the actuators can be designed to receive fingers therewithin as well as being of the push button variety. In reality, it is preferred that the actuators be designed to receive the finger and thumb tips to increase the maneuverability of the same.

I claim:

1. A puppet having a body, a pair of arms and a pair of legs disposed at the extremities thereof, means movably supporting each of the arms and legs with respect to the body, an actuator for each arm and leg for controlling movement of the same, each of said arms being comprised of a V-shaped member with the apex of the V being pivotally disposed on the body with one leg thereof supporting a forearm and a hand at one end thereof and the other supporting said actuator for imparting movement thereto, a head movably disposed on the body and including an actuator for controlling movement of the same, and a single means extending from said body and adapted to be engaged by the hand of a user with each finger thereof being positioned to engage one of the actuators for controlling movement of the arms, legs or head, respectively.

2. The puppet of claim 1 wherein each of said arm actuators has a cable means connected to said forearm for imparting additional movement to said hands.

3. The puppet of claim 2 wherein the head is movably positioned within a socket and terminates in an actuating arm having said finger-engaging head actuator at the free end thereof.

4. The puppet of claim 3 wherein each of the legs are pivoted to the body and are comprised of a pair of pivoted links terminating in feet with an actuator extending therefrom having said finger-engaging leg actuator positioned thereon.

* * * * *